United States Patent [19]

Sugiura

[11] 4,402,622

[45] Sep. 6, 1983

[54] INK-RIBBON LIFTING APPARATUS

[75] Inventor: Toshiaki Sugiura, Nagoya, Japan

[73] Assignee: Brother Kogyo Kabushiki Kaisha, Nagoya, Japan

[21] Appl. No.: 249,235

[22] Filed: Mar. 30, 1981

[30] Foreign Application Priority Data

Apr. 15, 1980 [JP] Japan ..... 55-50188

[51] Int. Cl.[3] ..... B41J 35/08; B41J 35/10; B41J 33/56

[52] U.S. Cl. ..... 400/212; 400/213.1; 400/234

[58] Field of Search ..... 400/213, 213.1, 211, 400/212, 215, 248, 216, 234

[56] References Cited

U.S. PATENT DOCUMENTS

| | | | |
|---|---|---|---|
| 677,111 | 6/1901 | Brooks | 400/216 X |
| 3,302,766 | 2/1967 | Page | 400/213.1 |
| 3,346,090 | 10/1967 | Goff, Jr. et al. | 400/213.1 X |
| 3,731,781 | 5/1973 | Caudill et al. | 400/213.1 X |
| 4,132,485 | 1/1979 | Hess | 400/234 X |

FOREIGN PATENT DOCUMENTS

| | | | |
|---|---|---|---|
| 2743256 | 4/1979 | Fed. Rep. of Germany | 400/213 |
| 56-67288 | 6/1981 | Japan | 400/212 |
| 873142 | 7/1961 | United Kingdom | 400/248 |

*Primary Examiner*—Edgar S. Burr
*Assistant Examiner*—Charles A. Pearson
*Attorney, Agent, or Firm*—Browdy & Neimark

[57] ABSTRACT

Ribbon lifting apparatus for a printing device having a print wheel and a ribbon cartridge. The lifting apparatus includes a pair of ribbon guides for supporting an exposed portion of a ribbon extending from an outlet opening of the ribbon cartridge to an inlet opening thereof. The pair of ribbon guides are supported by respective pairs of supporting levers which are swung in a plane parallel to the face plane of the print wheel. The pair of ribbon guides are lifted so that the lifting movement of the guides causes variation of a distance therebetween for keeping the path of the exposed length of ribbon substantially constant.

7 Claims, 5 Drawing Figures

INK-RIBBON LIFTING APPARATUS

SUMMARY OF THE INVENTION

This invention relates to a typewriter and more particularly to an ink-ribbon lifting apparatus thereof.

In a printing device having a print wheel of a flat circular shape, an exposed portion of ribbon extending from an outlet opening to an inlet opening of a ribbon cartridge is moved up and down by a ribbon lifting apparatus in an extremely narrow clearance between the print wheel and a platen. Conventional lifting apparatuses, therefore, are not suitable for this type of printing device.

The principle object of this invention is to provide an ink-ribbon lifting mechanism wherein the ink-ribbon is smoothly moved up and down in the extremely narrow clearance between the print wheel and the platen, with slackening and wrinkles which may occur due to the movement of the ink-ribbon being reduced as much as possible.

The ribbon lifting apparatus in accordance with this invention comprises a drive means, an operating lever connected with the drive means and movable to different positions upon movement of the drive means, a pair of supporting means pivotally supported on a base plate and operatively connected with the operating lever so as to be swung to different positions upon different movements of the operating lever, and a pair of ribbon guides for supporting the ribbon in a plane parallel to a surface of the print wheel and defining a ribbon path of the exposed portion of ribbon in cooperation with the outlet opening and the inlet opening so as to enable the ribbon to pass between the platen and the print wheel. The pair of ribbon guides are each supported by the respective supporting means, and movable to different positions upon different pivotal movements of the supporting means so that the different transversely spaced, longitudinally extending regions of the exposed portion of ribbon are positioned in the plane.

The pair of ribbon guides are preferably supported by the supporting means so that the different movements of the ribbon guides cause a variation in distance therebetween for keeping the exposed length of the ribbon substantially constant.

DETAILED DESCRIPTION OF A PREFERRED EMBODIMENT

With reference to the appended drawing a preferred embodiment will be described hereunder.

Figure 1:
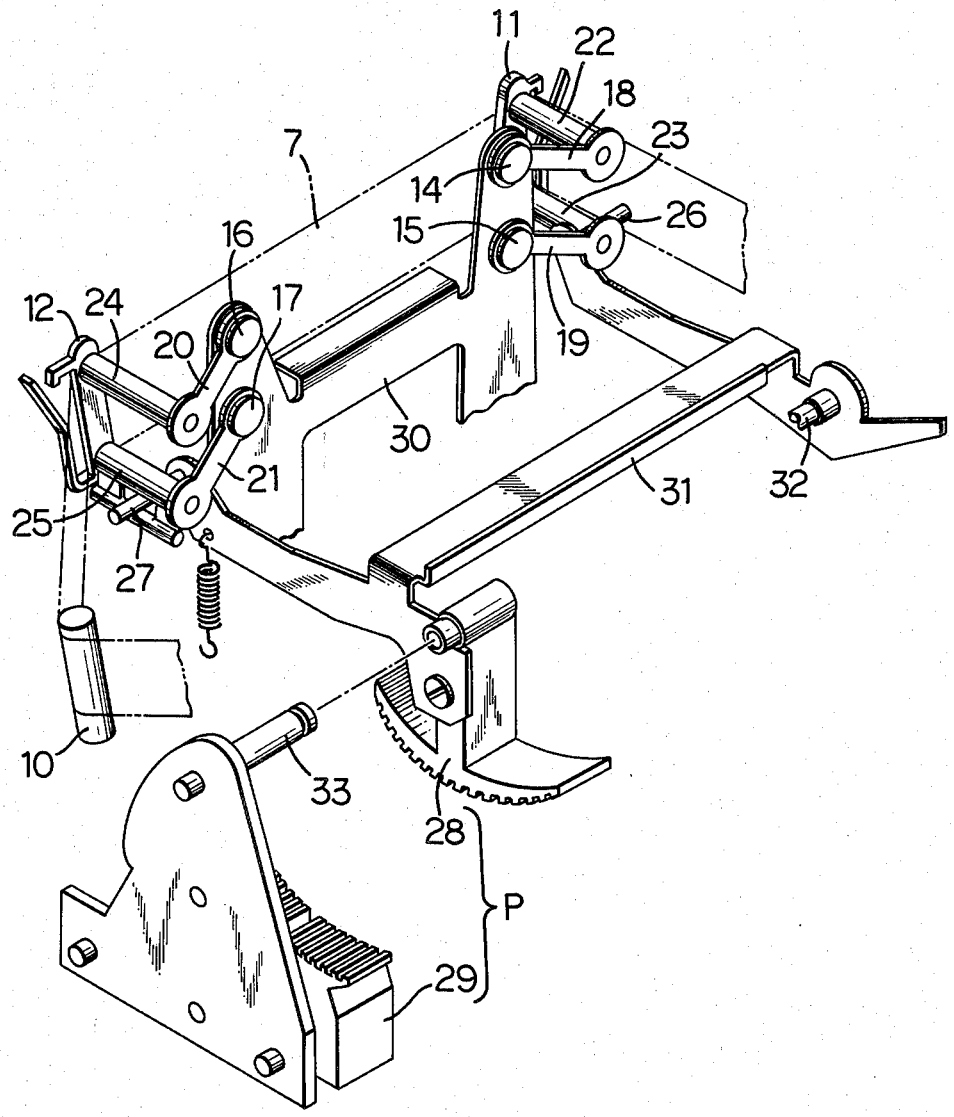
FIG. 1 is a perspective view, partly exploded, of an ink-ribbon lifting mechanism in accordance with this invention.
Figure 2:
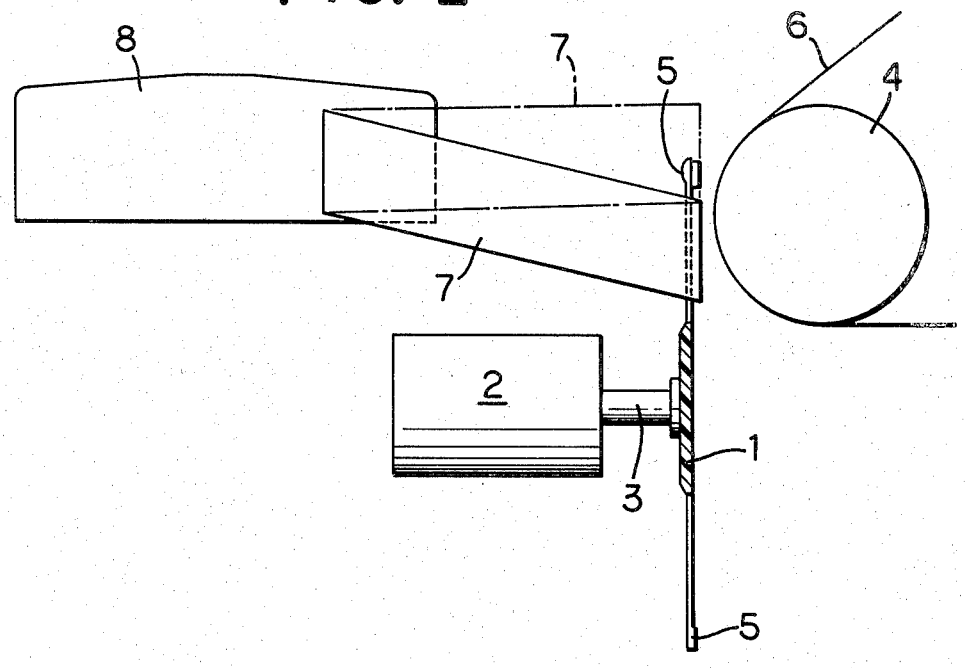
FIG. 2 is a side view showing the movement of an ink-ribbon.
Figure 4:
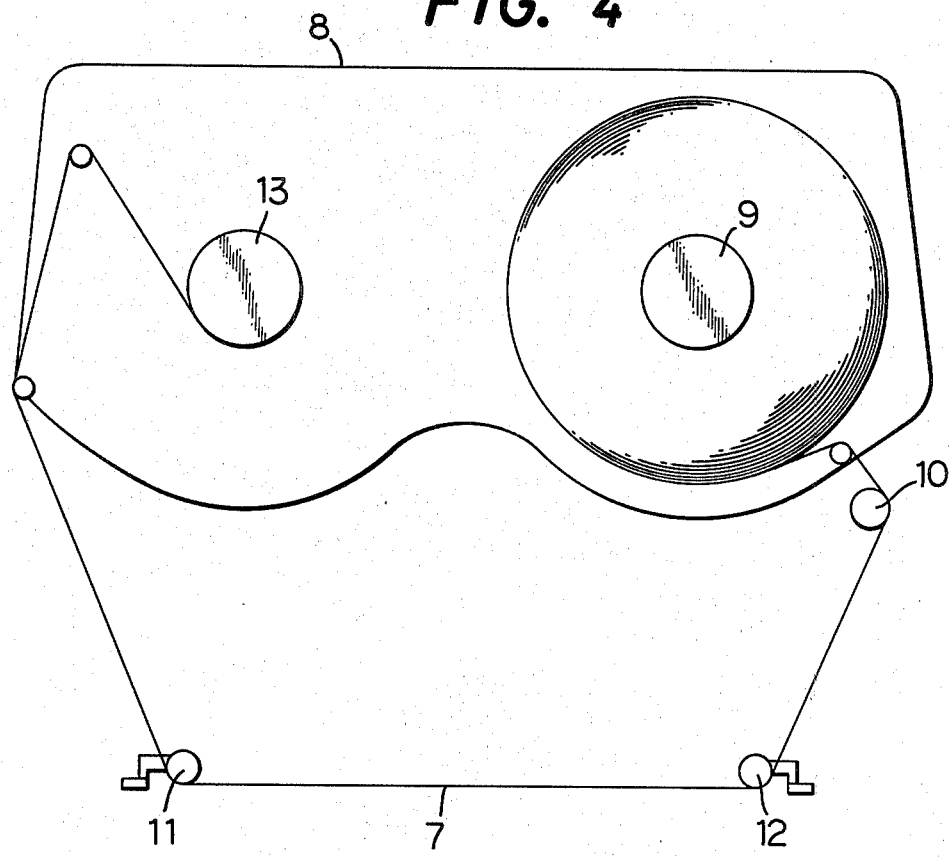
FIG. 4 is a plan view for showing the path or route of the ink-ribbon.
Figure 5:
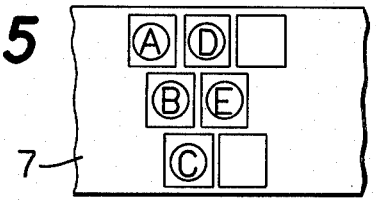
FIG. 5 is an explanatory view showing how the ink-ribbon is used.

A type wheel 1 or a print wheel shown in FIG. 2, is of well known structure, whose central portion is secured to a rotary shaft 3 of a pulse motor 2, and has a plurality of arms extending radially from the central portion. Each of the radial arms carries a type 5 facing a platen 4. Within a clearance formed between the print wheel 1 and a printing paper 6 placed along the surface of the platen 4 an ink-ribbon 7 is moved substantially vertically in a range shown in FIG. 2 with a solid line and a one-dot-chain line. This ink-ribbon 7 is a carbon type of a large width, consisting of three longitudinally extending bands or regions transversely spaced across the width of the ink-ribbon 7 as can be seen in FIG. 5, and the greater part thereof is accommodated in a ribbon cassette or cartridge 8 carried on a not-shown carrier together with the pulse motor 2. As illustrated in FIG. 4 an exposed length of the ink-ribbon 7 which is pulled out of the cartridge 8 from a reel 9 on the supply side by way of a constant tension giving member 10 and a pair of ribbon guides 11, 12 on both left and right sides, is wound on a reel 13 on the take-up side. The reel 13 is given in each printing operation a rotational force for advancing the ink-ribbon 7 by a distance corresponding to $\frac{1}{3}$ of the width of one type or character. The reel 9 on the supply side is kept under the influence of a resilient force resisting to a certain extent the pulling force exerted from the reel 13. This resilient force cooperates with the constant tension giving member 10 for maintaining the tension between both reels 9, 13 constant.

The ink-ribbon 7 with the three longitudinal regions is repeatedly moved up and down in cycle by the ribbon guides 11, 12 between the original position shown with a solid line in FIG. 2, where a type to be printed on the printing paper 6 is above and free from the ink-ribbon 7, and one of three lifted positions to bring a corresponding one of the three regions into alignment with the type to be printed (only the most-lifted or uppermost position is illustrated in FIG. 2 in one-dot chain line). In each printing operation with the ribbon advance by a distance equal to one-third of the type width, the ink-ribbon 7 is vertically oscillated so that the three longitudinal regions are alternately brought into position to print selected types, for example, A, B, C, D and E, in that order in the different regions as shown in FIG. 5. If a printing operation ceases for more than a predetermined time duration, this vertical movements of the ribbon 7 are suspended and the ribbon 7 is returned to the original position thereof.

The ribbon lifting apparatus is constructed such that, for the purpose of up and down moving of the ink-ribbon 7 of a large width by means of the ribbon guides 11, 12 in the narrow clearance between the print wheel 1 and the printing paper 6 without touching either of the two, the ink-ribbon 7 can be swung in a plane parallel to the print wheel 1 such that the length as well as the tension of the ink-ribbon 7 pulled out of the ribbon cartridge 8 can be maintained substantially constant during the swinging movement thereof.

Both of the ribbon guides 11, 12 are supported by supporting mechanisms of the same structure, so only the supporting mechanism for the ribbon guide 11 is described, leaving that for the ribbon guide 12 undescribed while using only reference numerals of the corresponding parts in the brackets.

A pair of levers 18, 19 (20, 21) are pivoted, in a plane substantially parallel to the surface of the print wheel 1, at one end thereof about respective support pins 14, 15 (16, 17) on a retaining member 30 designed as a base plate carried by a carrier or a carriage. To the other end of the levers 18, 19 (20, 21) there are connected respective connecting rods 22, 23 (24, 25) at one end thereof. The ribbon guide 11 (12) is supported by the other end of the connecting rods 22, 23 (24, 25) oscillatingly in a plane parallel to the print wheel 1. Each ribbon guide 11, 12 is operatively connected to a pulse motor P designed as a drive means through engagement of the connecting rod 23, 25 with an engaging rod 26, 27. The engaging rod 26, 27 is respectively connected by way of operating levers 31 to a rotor 28 of the pulse motor P. The pulse motor P consists of the rotor 28 of sectorial shape and a stationary member 29 having an inner surface facing the sectorial periphery of the rotor 28. The operating lever 31 is pivotally supported via shafts 32, 33 by the carriage and swung by the pulse motor P causing a vertical oscillating action of the engaging rod 26, 27.

Figure 3:
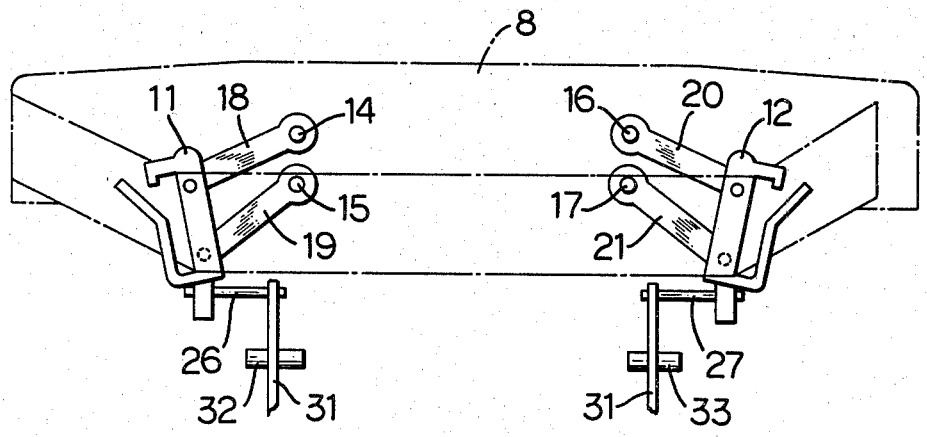
FIG. 3 is an elevational view showing the positional relation between a pair of ribbon guides and the ink-ribbon.

The ribbon guides 11, 12 thus operationally connected to the pulse rotor P are oscillated as mentioned above by an amount corresponding to an amount of rotation of the pulse motor P such that the ink-ribbon 7 is positioned from the original position shown with the solid line in FIG. 2 to one of the three lifted positions. The vertical oscillation of the ribbon guides 11, 12 begins from the position shown in FIG. 3 to go upwards, following an arcuate path in said plane causing gradual changing of the distance between both ribbon guides 11, 12 in response to the progress of the vertical oscillating movement.

The changing of the distance is to prevent slackening of the exposed portion of the ribbon 7 and to maintain a constant tension thereof by constantly maintaining the length of the path of the exposed ink-ribbon 7 while the ribbon guides 11, 12 are moved up and down in the plane parallel to the print wheel 1, because the length of the exposed ink-ribbon out of the ribbon cartridge 8, viz., the length of the ink-ribbon 7 from an outlet opening on the supply side by way of the ribbon guides 11, 12 to an inlet opening on the take-up side, is always constant.

In other words, while the ink-ribbon 7 is lifted from the original position to the most-lifted position, the distances from the inlet opening of the ribbon cartridge 8 on the take-up side to the ribbon guide 11 and from the outlet opening on the supply side to the ribbon guide 12 decrease first and begin to increase immediately before the ink-ribbon 7 reaches the most-lifted position. The whole length of the path of the exposed portion of the ink-ribbon 7 is maintained constant, because the distance between both ribbon guides 11, 12 is so changed or varied as to absorb the increasing amount or the decreasing amount just mentioned.

The ribbon lifting apparatus in accordance with this invention is capable, despite the unfavorable conditions that the ribbon is of large width and the movement thereof is in an extremely narrow clearance between the print wheel and the printing paper 6, of moving the ribbon up and down in the narrow clearance without touching either of the print wheel 1 or the printing paper 6 and also of maintaining the length and the tension of the ribbon exposed outside the ribbon cartridge 8 constant, thereby preventing slackening and wrinkling from taking place in the ribbon to thereby assure exact printing operations.

What is claimed is:

1. In a printing device including a base plate, platen, a print wheel, a ribbon cartridge having outlet and inlet openings and accommodating a ribbon, and a ribbon lifting apparatus to guide an exposed portion of the ribbon looped out of the cartridge through the outlet and inlet openings in a space between the platen and the print wheel and to selectively position, during a printing operation, different transversely spaced longitudinally extending regions of the ribbon, said ribbon lifting apparatus comprising:

drive means;

an operating lever connected to said drive means and movable to different positions upon actuation of said drive means;

a pair of ribbon guides supporting said exposed portion of the ribbon in a first plane parallel to the surface of said print wheel and defining, in cooperation with said outlet and inlet openings, a path of said exposed portion; and a pair of supporting means, each operatively connected to said operating lever, for supporting said pair of ribbon guides, respectively, in said first plane, each of said pair of supporting means being pivotally connected to said base plate and moved by said operating lever in a second plane substantially parallel to said first plane to different levels corresponding to an original position and at least one lifted position of said ribbon guides, said different levels being established upon movement of said operating lever to said different positions, respectively, the pivotal motion of said supporting means causing said ribbon guides to move toward and away from each other changing the distance therebetween, whereby said pair of ribbon guides are positioned by said operating lever via said supporting means such that said exposed portion of the ribbon is oscillated to bring said different regions thereof into line with the printing position and such that said pair of ribbon guides are laterally moved to maintain said path of the exposed portion of the ribbon substantially constant in length.

2. A printing device as recited in claim 1, wherein each of said ribbon guides follows an arcuate path in said first plane when said supporting means is pivoted to said different levels.

3. A printing device as recited in claim 1, wherein each of said supporting means comprises a fixed end portion pivotally connected to said base plate, and a free end portion which is fixed to said ribbon guide and located outwardly along said platen with respect to said fixed end portion.

4. A printing device as recited in claim 3, wherein said pair of supporting means each comprise a pair of pivot levers each including said fixed end portion, and a pair of connecting rods pivotally connecting said pair of pivot levers to said ribbon guides and spaced in a direction substantially across the width of said exposed portion, said connecting rods each cooperating with the free end of said pivot levers to constitute said free end portion.

5. A printing device as recited in claim 1, wherein said pair of supporting means each comprise a pair of pivot levers pivotally connected at one end thereof to said base plate and pivoted about said one end, and a pair of connecting rods pivotally connecting said pair of pivot levers to said ribbon guides, said connecting rods being spaced in a direction substantially across the width of said exposed portion of the ribbon.

6. A printing device as recited in claim 4 or 5, wherein said drive means comprises a stepping motor having a stator and a rotor.

7. A printing device as recited in claim 6, wherein said operating lever comprises a free end engaging a part of said connecting rods and a fixed end pivotally connected to said rotor such that said free end of the operating lever is moved to said different positions upon controlled rotation of said rotor.

* * * * *